United States Patent [19]

Sitzler et al.

[11] Patent Number: 4,938,314

[45] Date of Patent: Jul. 3, 1990

[54] PLASTIC OIL PAN

[75] Inventors: Klaus Sitzler, Stuttgart, Fed. Rep. of Germany; Herbert Ampferer, Sachsenheim, Austria

[73] Assignee: Dr. Ing. h.c.F. Porsche AG, Fed. Rep. of Germany

[21] Appl. No.: 429,993

[22] Filed: Nov. 1, 1989

[30] Foreign Application Priority Data

Nov. 11, 1988 [DE] Fed. Rep. of Germany ..... 3838250

[51] Int. Cl.[5] ..... F16N 33/00

[52] U.S. Cl. ..... 184/1.5; 123/195 C; 411/180; 138/89; 220/288; 277/177

[58] Field of Search ..... 123/196 R, 195 C; 184/1.5; 411/180; 138/89; 220/288, 304; 29/525; 277/177, 173, 168; 285/918

[56] References Cited

U.S. PATENT DOCUMENTS

| | | | |
|---|---|---|---|
| 3,246,674 | 4/1966 | Kapeker | 285/918 |
| 3,955,648 | 5/1976 | Walker, Jr. et al. | 184/105.2 |
| 4,066,281 | 1/1978 | De Bonis | 285/31 |
| 4,472,861 | 9/1984 | Joseph et al. | 411/547 |
| 4,522,165 | 6/1985 | Ogawa | 123/195 C |

FOREIGN PATENT DOCUMENTS

| | | | |
|---|---|---|---|
| 2917934 | 11/1980 | Fed. Rep. of Germany | 411/180 |
| 3042969 | 1/1990 | Fed. Rep. of Germany . | |
| 3246768 | 1/1990 | Fed. Rep. of Germany . | |
| 8503800 | 9/1986 | France . | |

OTHER PUBLICATIONS

German Book entitled "Plastics and Elastomere In The Sealing Technologies" by Wilhelm Schmitt, Stuttgart 1987.

*Primary Examiner*—Ira S. Lazarus
*Assistant Examiner*—Alan Cariaso
*Attorney, Agent, or Firm*—Evenson, Wands, Edwards, Lenahan & McKeown

[57] ABSTRACT

A plastic oil pan for internal-combustion engines is disclosed which includes an oil drain plug screwed into a threaded insert. This oil drain plug is braced with respect to the threaded insert. In order to avoid an undesirable discharge of oil when the oil drain plug is fixed, a radial seal is operative between the oil drain plug and a recess in a local thickening of the oil pan.

9 Claims, 1 Drawing Sheet

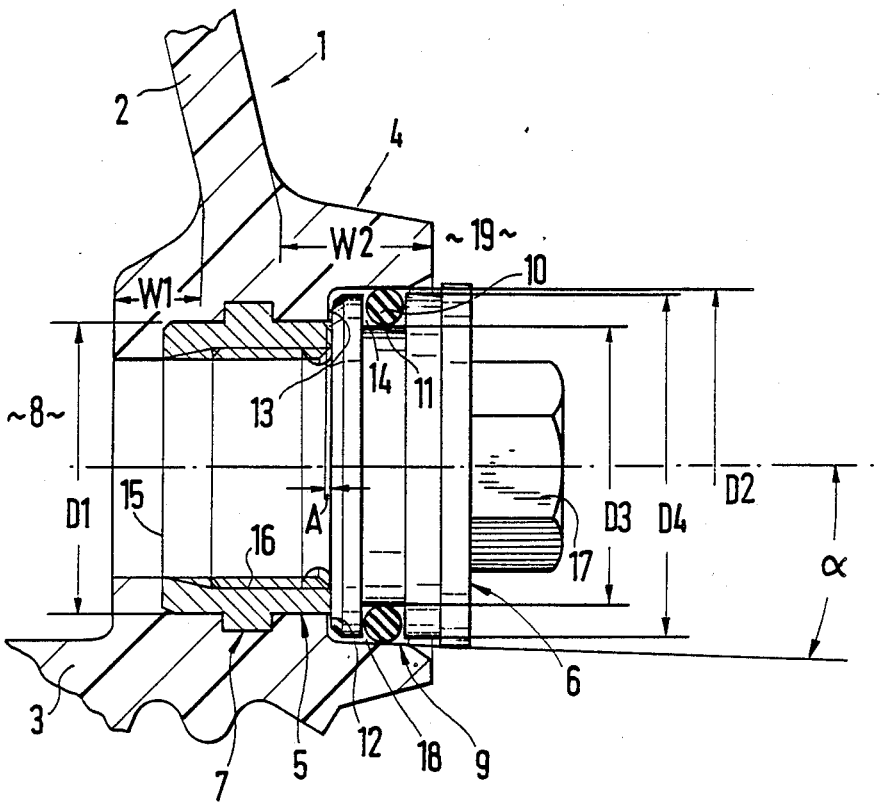
1
2
4
W2
~19~
10
W1
~8~
13
14
11
D1
15
A
16
D3
D4
D2
17
α
6
3
7
5
12
18
9

PLASTIC OIL PAN

AND SUMMARY OF THE INVENTION

The invention relates to a plastic oil pan for internal combustion engines of the type having an oil drain plug which is screwed into a threaded insert resting in a wall of the pan.

On the basis of German Patent (DE-PS) No. 32 46 768, a metallic threaded insert in a plastic wall is known in which an elastic sealing ring is provided for the sealing between the threaded insert and the plastic wall. The sealing ring is arranged in a groove. This construction has the disadvantage that, even in the case of slight tolerance deviations, there is a discharge of liquid and/or gas.

It is an object of the invention to take such measures at an oil drain plug for a plastic oil pan of an internal-combustion engine that it is secured with respect to an undesired discharge of oil.

According to the invention, this object is achieved by providing an arrangement wherein the oil drain plug is braced by means of a projection with respect to the threaded insert and cooperates with at least one sealing means constructed as a radial seal within a circular-cylindrical recess formed between a thickening of the wall and a receiving section of the oil drain plug.

According to certain preferred embodiments of the invention, an arrangement is provided wherein the threaded insert is fixed in a thickening of the wall and, on the side facing away from an interior space of the oil pan, leads into a space which is sealed off by a radial seal with respect to an exterior side of the oil pan, the radial seal interacting with a circular-cylindrical recess of the thickening and a receiving section of the oil drain plug.

The principal advantages achieved by means of the invention are that the radial seal between the plug and the recess is highly effective, i.e., in the screwed-in position, does not permit any oil to penetrate, in which case, if necessary, any occurring leakage between the oil pan and the threaded insert is accepted. A good sealing function can be achieved by one, or possibly several O-rings connected behind one another which, in a simple manner, can be inserted into the groove of the receiving section. In addition, in this construction, the maintaining of manufacturing tolerances also does not present any problems.

Other objects, advantages and novel features of the present invention will become apparent from the following detailed description of the invention when considered in conjunction with the accompanying drawings.

BRIEF DESCRIPTION OF THE DRAWINGS

The single drawing FIGURE is a longitudinal sectional partial view of an oil pan with an oil drain plug constructed according to a preferred embodiment of the invention.

DETAILED DESCRIPTION OF THE DRAWINGS

A plastic oil pan 1 comprises an upright wall 2 and a horizontal wall 3. Reference number 4 marks a local thickening which is provided in the transition area between wall 2 and wall 3. The thickening, which projects beyond both sides of wall 2—W1 and W2— is used for receiving a threaded insert 5 into which an oil drain plug 6 is screwed. The two latter devices consist of metal.

The threaded insert 5, which is embedded under pressure into the plastic material without any sealing, i.e., without any additional sealing, has a basic circular-cylindrical shape and is provided with a multiple-cornered antitwist device 7 which projects beyond the outside diameter D1 of the threaded insert 5.

The thickening 4 has a circular-cylindrical recess 9 on the side facing away from an interior space 8 of the oil pan 1. This recess is similar to a bore. It is also possible to provide the recess as a cone with an opening slope $\alpha$. A radial seal 10 extends in the recess 9 which, on one side cooperates with the recess 9—D2— and, on the other side, with a grooved section 11—D3— for the radial seal 10 at the oil drain plug 6. In other words, the oil drain plug 6 extends in sections inside the recess. In addition, a projection 12 of the oil drain plug 6 is axially braced against the threaded insert 5, the threaded insert 5 projecting slightly by an amount A relative to a border 13 of the recess 9 extending in parallel to projection 12.

The radial seal 10 is an O-ring consisting of a flexible material—several O-rings may also be connected behind one another in axial direction—which is inserted into a groove 14 of the oil drain plug 6. The outside diameter D4 of the groove 14 is slightly smaller than the inside diameter D2 of the recess 9.

By means of a threaded stem 15, the oil drain plug 6 is screwed into a threaded bore 16 of the threaded insert 5, a screw head 17 being used for the operating of the oil drain plug 6.

On the side facing away from the interior space 8, the threaded insert 5 leads into a space 18 of the thickening 4 which is sealed off by means of the radial seal 10 with respect to the exterior side 19 of the oil pan 1. In this case, the radial seal 10 cooperates with the oil drain plug 6—more precisely, with the grooved section 11—as well as with the cylindrical recess 9.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A plastic oil pan for internal-combustion engines having an oil drain plug which is screwed into a threaded insert, the threaded insert resting in a wall of the plastic oil pan, wherein the oil drain plug is braced by means of a projection with respect to the threaded insert and cooperates with at least one sealing means constructed as a radial seal within a circular-cylindrical recess formed between a thickening of the wall and a receiving section of the oil drain plug.

2. A plastic oil pan according to claim 1, wherein the threaded insert, adjacent to the projection of the oil drain plug, projects slightly beyond a border of the recess extending parallel to the projection, inside the thickening.

3. A plastic oil pan according to claim 1, wherein the radial seal is an O-ring which is inserted into a groove of the receiving section of the oil drain plug

4. A plastic oil pan according to claim 1, wherein the outside diameter of the receiving section is slightly smaller than the inside diameter of the recess.

5. A plastic oil pan according to claim 3, wherein the outside diameter of the receiving section is slightly smaller than the inside diameter of the recess.

6. A plastic oil pan according to claim 2, wherein the threaded insert is Provided with a multi-cornered antitwist device.

7. A plastic oil pan according to claim 6, wherein the threaded insert, is surrounded by the plastic material of the oil pan without any additional seal.

8. A plastic oil pan for internal-combustion engines having an oil drain plug which is screwed into a threaded insert, the threaded insert resting in a wall of the plastic oil pan, wherein the threaded insert is fixed in a thickening of the wall and, on the side facing away from an interior space of the oil pan, leads into a space which is sealed off by a radial seal with respect to an exterior side of the oil pan, the radial seal interacting with a circular-cylindrical recess of the thickening and a receiving section of the oil drain plug.

9. A plastic oil pan according to claim 8, wherein the threaded insert is surrounded by the plastic material of the oil pan without any additional seal.

* * * * *